US006662473B2

(12) United States Patent
Chen

(10) Patent No.: US 6,662,473 B2
(45) Date of Patent: Dec. 16, 2003

(54) SHOE WITH ERGONOMIC INSOLE UNIT

(76) Inventor: Eddie Chen, 9F, No. 201, Sec. 1, Taichung-Kang Rd., Taichung City (TW)

( * ) Notice: Subject to any disclaimer, the term of this patent is extended or adjusted under 35 U.S.C. 154(b) by 35 days.

(21) Appl. No.: 10/105,290

(22) Filed: Mar. 26, 2002

(65) Prior Publication Data

US 2003/0182821 A1 Oct. 2, 2003

(51) Int. Cl.[7] ..... A43B 13/38; A43B 9/10

(52) U.S. Cl. ..... 36/44; 36/16; 36/37; 36/68; 36/76 HH

(58) Field of Search ..... 36/44, 16, 37, 36/68, 76 HH, 43, 69

(56) References Cited

U.S. PATENT DOCUMENTS 2,255,100 A * 9/1941 Brady ..... 36/173
2,660,814 A * 12/1953 Ritchey ..... 36/178
2,724,914 A * 11/1955 Wick ..... 36/37
4,506,460 A * 3/1985 Rudy ..... 36/28
4,622,764 A 11/1986 Boulier
4,776,109 A * 10/1988 Sacre ..... 36/3 B
5,544,432 A * 8/1996 Kita ..... 36/43
6,070,342 A * 6/2000 Brown ..... 36/44
6,560,899 B2 * 5/2003 Chen ..... 36/14

* cited by examiner

*Primary Examiner*—Ted Kavanaugh
(74) *Attorney, Agent, or Firm*—Baker Botts L.L.P.

(57) ABSTRACT

A shoe includes an ergonomic insole unit, and an upper with a bottom margin connected directly to a periphery of the insole unit. The insole unit has a heel part which includes a planar bottom face, a rear upward flange extending upward from the heel part and a concave inner surface which extends gradually upward and outward from a mid part of the heel part to the upward flange. The thickness of the heel part decreases gradually from the upward flange to the mid part and thus substantially conforms to the contour of the bottom face of the wearer's heel. The ergonomic insole unit contacts and supports sufficiently all part of the wearer's heel for better distribution of the weight of the wearer.

18 Claims, 14 Drawing Sheets

SHOE WITH ERGONOMIC INSOLE UNIT

BACKGROUND OF THE INVENTION

1. Field of the Invention

The invention relates to a shoe, particularly, to a shoe which has an ergonomic insole unit incorporated therein.

2. Description of the Related Art

Conventional lasts for making shoes generally have planar bottom faces at heel regions. Although manufacturers are aware that the wearers' heels are substantially semicircular at their bottoms, lasts used in lasting heels are not provided with a bottom having the same profile as that of the wearer's heel since the bottom profile of the lasts cannot accommodate a heel lasting machine. A heel lasting machine normally has a wiper blade that traverses the bottom face of a last so as to fold and press a lower margin of an upper over and against an insole supported by the last bottom. As the wiper blade traverses linearly and immediately below the last, the last is provided with a planar surface (1A), as shown in FIGS. 1A and 1B, so as to avoid interference with the movement of the wiper blade. If the last bottom is convex, the insole and/or the bottom margin of the upper can be damaged by the wiper blade, and difficulties will be encountered in the heel lasting process.

Since the last bottom is planar, the insole used in a lasted shoe is usually planar. The planar insole is insufficient to cushion and comfort the wearer's foot since it does not contact and support sufficiently all parts of the foot other than the foot palm and the heel. Stress concentration thus occurs at the foot palm and the heel due to the weight of the wearer's body. The heel can even get injury at the calcaneus in case of prolonged wearing of the shoe incorporating such planar insole.

It is known to provide a last with a bottom face conforming to the bottom of the wearer's foot in manufacturing a sandal since no heel lasting machine is used in making the sandal. An example of such a last is shown in FIG. 2A & 2B at 2 and has a convex bottom face 2A. A sandal 3 made by using the last 2 is shown in FIG. 3 and has a foot bed 31 which can be in proper fit with the wearer's foot to support all areas of the foot bottom so that the weight of the wearer can be distributed to all parts of the foot bottom. Such a foot bed can not be provided in shoes, such as sport shoes, walking shoes, etc., which are produced via heel lasting machines.

It is usual to provide a shoe with a reinforcement piece, such as, a counter or stiffener, at the heel section of the shoe. For example, U.S. Pat. No. 4,622,764 discloses a molded shell made of a rigid material, such as a rigid plastic or metal, so as to reinforce the rear portion of the shoe. The molded shell is placed at the outer side of an upper and a lasted insole, and is assembled with the upper after the upper is lasted. As both of the molded shell and the insole have planar top and bottom faces, they do not conform to the wearer's heel.

To comfort the wearer's foot, it is conventional to place inside a shoe a removable foot pad which is concave at the top face thereof to match the convex bottom of the wearer's heel. However, although the foot pad is thick at the lateral parts thereof, the central concave part of the foot pad is usually thin and does not have enough thickness to cushion the convex part of the wearer's heel since the total thickness of the foot pad is limited by the height of the interior space of the shoe which is determined by a last used in manufacturing the shoe. If the foot pad is too thick, it would affect the originally predetermined dimensions of the interior space of the shoe.

SUMMARY OF THE INVENTION

An object of the present invention is to provide a shoe with an ergonomic insole unit which has a concave support face to match the contour of the convex bottom of the wearer's heel and which still permits a conventional heel lasting machine to perform a heel lasting operation though using a last with a heel section conforming to the wearer's heel.

Another object of the present invention is to provide a shoe with an ergonomic insole unit which has a concave support face to match the contour of the convex bottom of the wearer's heel and which still has a concave part with a thickness sufficient to cushion the wearer's heel.

Still another object of the present invention is to provide a shoe with an ergonomic insole unit which has a concave support face to match the contour of the convex bottom the wearer's heel and which can still be united with a conventional outsole that can be mass-produced.

Accordingly, a shoe according to the present invention comprises an ergonomic insole unit, and an upper having a top end disposed above the insole unit and a bottom margin attached directly to the insole unit, the insole unit including a heel part which includes a base and a rear upward flange projecting upward from a periphery of the base and making a U-shaped turn around the base, the upward flange extending inwardly of the bottom margin of the upper, the base having a planar bottom face,the rear upward flange having an outer surface extending upward from the planar bottom face of the base and forming a corner with the planar bottom face, the heel part further having a concave inner surface opposite to the outer surface and the bottom face, the inner surface extending gradually upward and outward along a direction from a mid part of the base to a top end of the upward flange and having a curved face extending along the corner, the heel part having, between the planar bottom face and the inner surface, a thickness which decreases gradually from the upward flange toward the mid part.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 4:
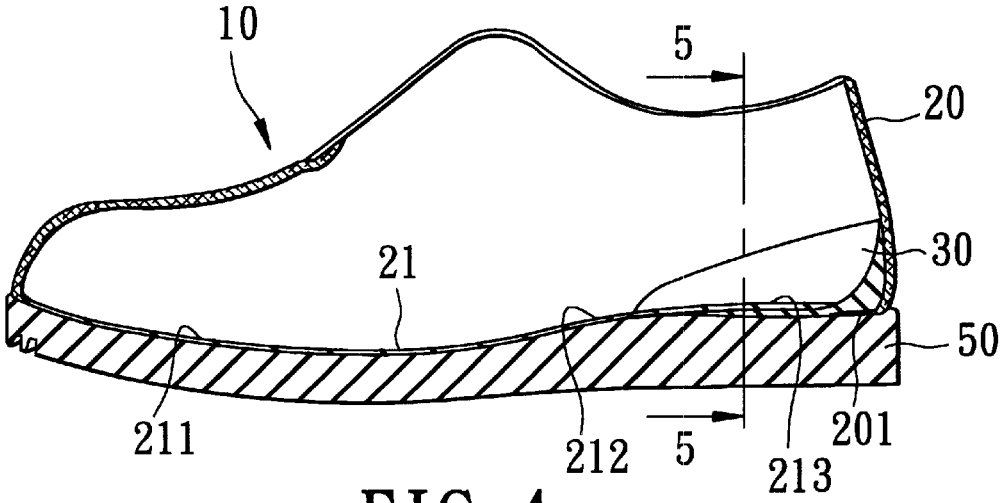
FIG. 4 is a sectional view of a shoe embodying the present invention.
Figure 5:
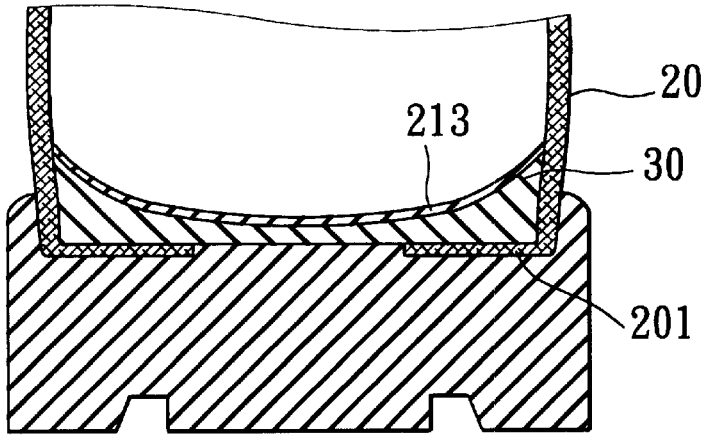
FIG. 5 is another sectional view of the shoe taken along line 5—5 of FIG. 4.

Referring to FIGS. 4 & 5, a first embodiment of a shoe 10 according to the present invention comprises an upper 20 connected to an ergonomic insole unit which includes an insole element 21 and a heel part 30 connected to the insole element 21 via connection means, such as adhesive bonding, sewing or mechanical fasteners, etc. The upper 20 has a bottom margin 201 provided around the insole element 21 and the heel part 30. The bottom margin 201 is attached to the insole element 21 and the heel part 30 via a lasting process.

Figure 6:
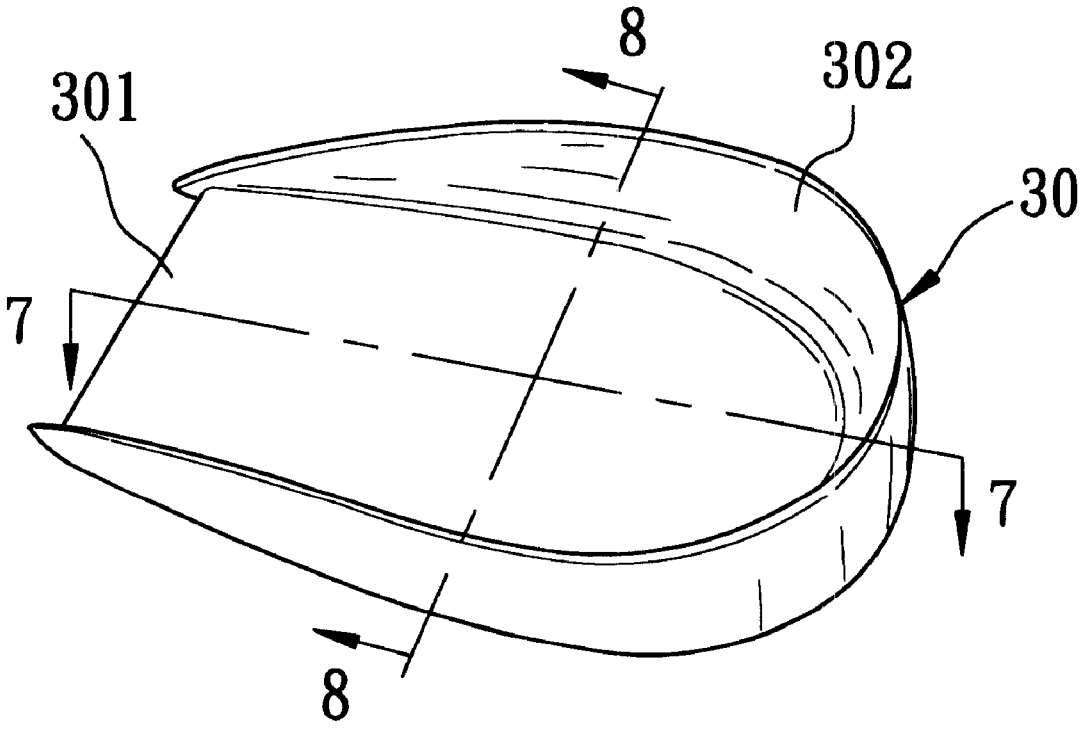
FIG. 6 is a perspective view of a heel part of an insole unit shown in FIG. 4.
Figure 7:
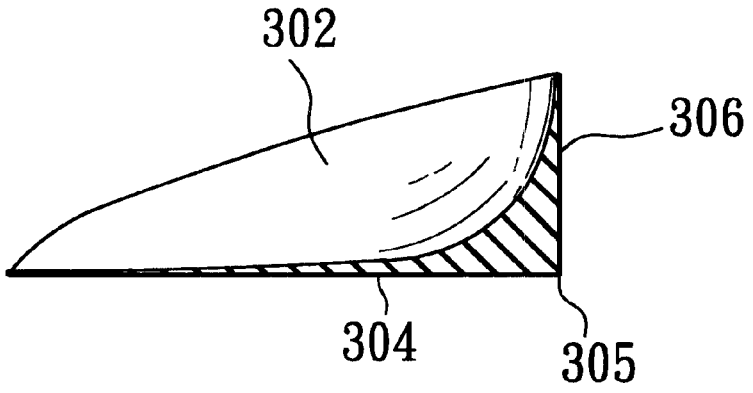
FIG. 7 is a sectional view taken along line 7—7 of FIG. 6.
Figure 8:
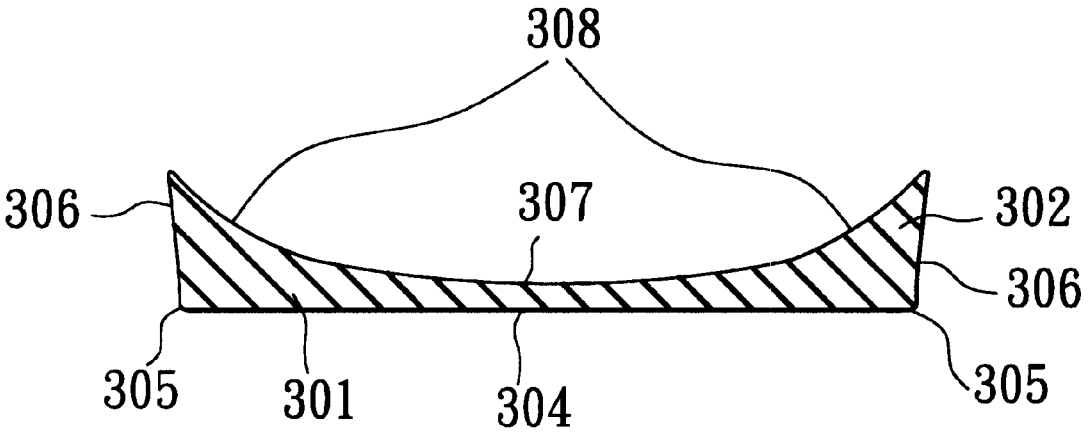
FIG. 8 is a sectional view taken along line 8—8 of FIG. 6.

The heel part 30 may be fabricated via a molding process from a rigid, semi-rigid, or flexible plastic material. The plastic materials usable for the heel part 30 include PVC, PU, EVA, EPE, etc. Referring to FIGS. 6, 7 and 8, the heel part 30 includes a base 301, and a rear upward flange 302 extending upward from the base 301 and making a substantially U-shaped turn around the base 301. The base 301 has a planar bottom face 304 which forms a corner 305 with an outer surface 306 of the upward flange 302. The heel part 30 further has an inner surface 307 which is opposite to the planar bottom face 304 and the outer surface 306. The inner surface 307 is concave and extends gradually upwardly and outwardly along a direction from a mid part of the base 301 to a top end of the upward flange 302. The height of the inner surface 307 from the bottom planar face 304 decreases gradually from the upward flange 302 toward the mid part of the base 301. The curvature 308 of the inner surface 307 opposite to the corner 305 has a diameter greater than 8 mm.

Figure 9:
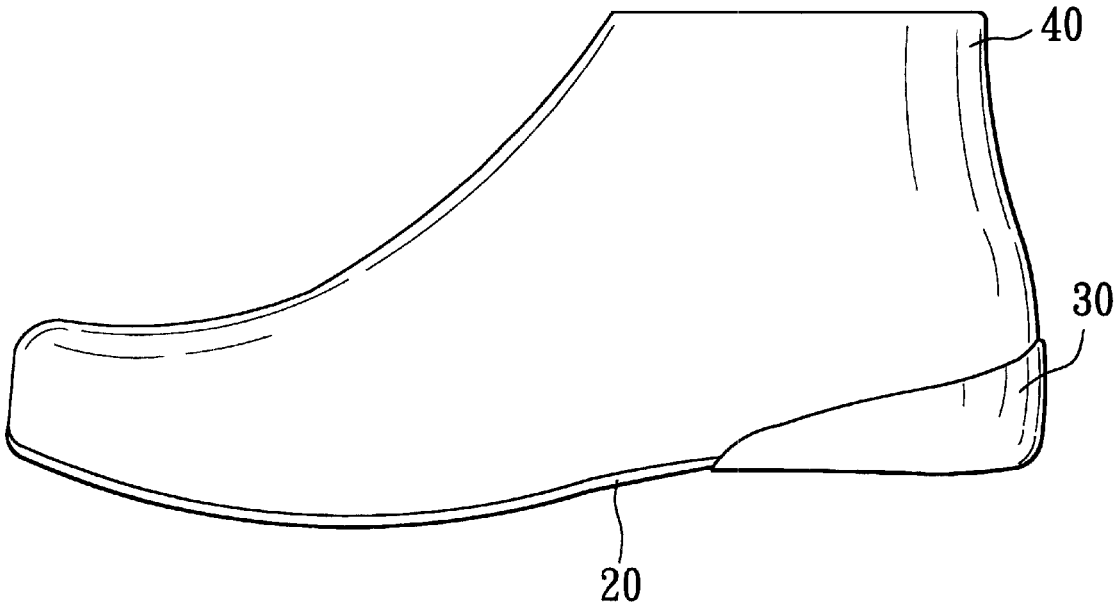
FIG. 9 is an elevation view showing an insole element and the heel part of FIG. 4, both of which are mounted on a last.

The insole element 21 has a toe section 211, a shank section 212, and a heel section 213, like the conventional insole. The insole element 21 is made of a flexible material such as PVC, EVA, a woven or non-woven fabric, or the like. The insole element 21 has a substantially uniform thickness, and the heel section 213 of the insole element 21 is placed above the base 301 of the heel part 30. In assembly, the insole element 21 and the heel part 30 are mounted on a bottom side of a last 40 as shown in FIG. 9 to undergo a lasting operation in a conventional manner. During the lasting operation, the upper 20 is also mounted on the last 40, and a portion of the bottom margin 201 is folded over and attached to the planar bottom face 304 of the heel part 30. The remaining portion of the bottom margin 201 of the upper 20 is folded over and attached to the bottom face of the insole element 21. After the lasting operation, the upper 20, the insole element 21 and the heel part 30 are assembled with an outsole 50 via a conventional soling process, such as a direct injection process to form the outsole 50, a cementing process to cement the outsole 50, or a goodyear welt process to attach a goodyear welt and the outsole 50.

Figure 1A:
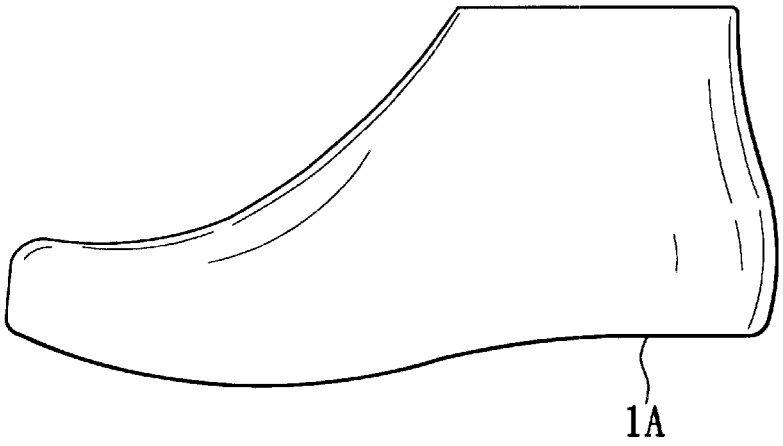
FIG. 1A PRIOR ART
FIG. 1A is a side view of a conventional last which is planar at the bottom of a heel region thereof.
Figure 1B:
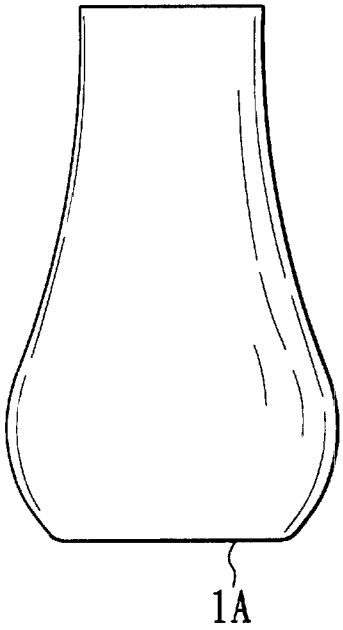
FIG. 1B PRIOR ART
FIG. 1B is a rear view of the conventional last of FIG. 1A.
Figure 2A:
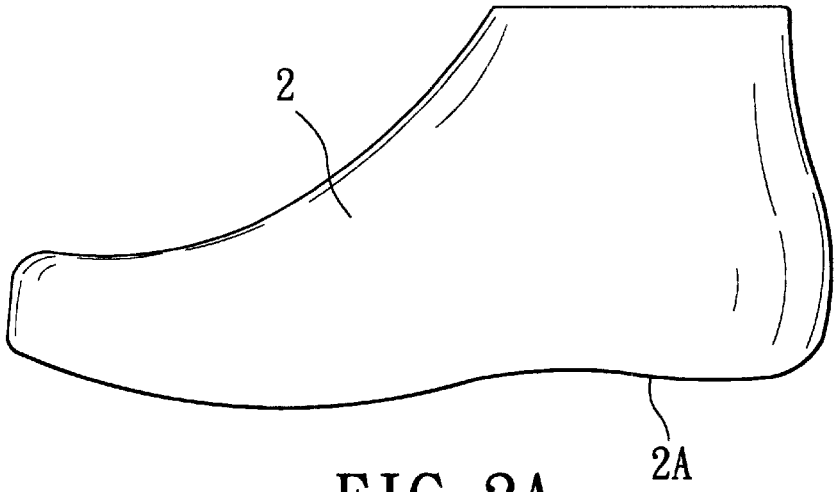
FIG. 2A PRIOR ART
FIG. 2A is a side view of another conventional last which is convex at the bottom of a heel region thereof.
Figure 2B:
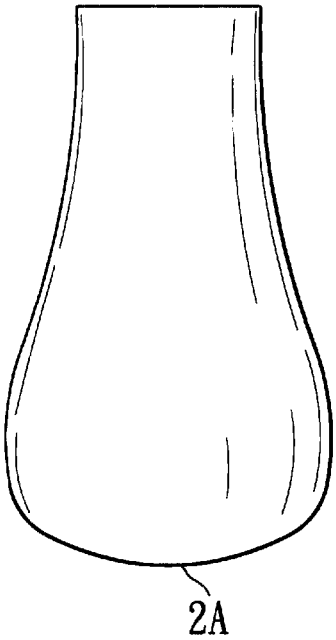
FIG. 2B PRIOR ART
FIG. 2B is a rear view of the conventional last of FIG. 2A.
Figure 3:
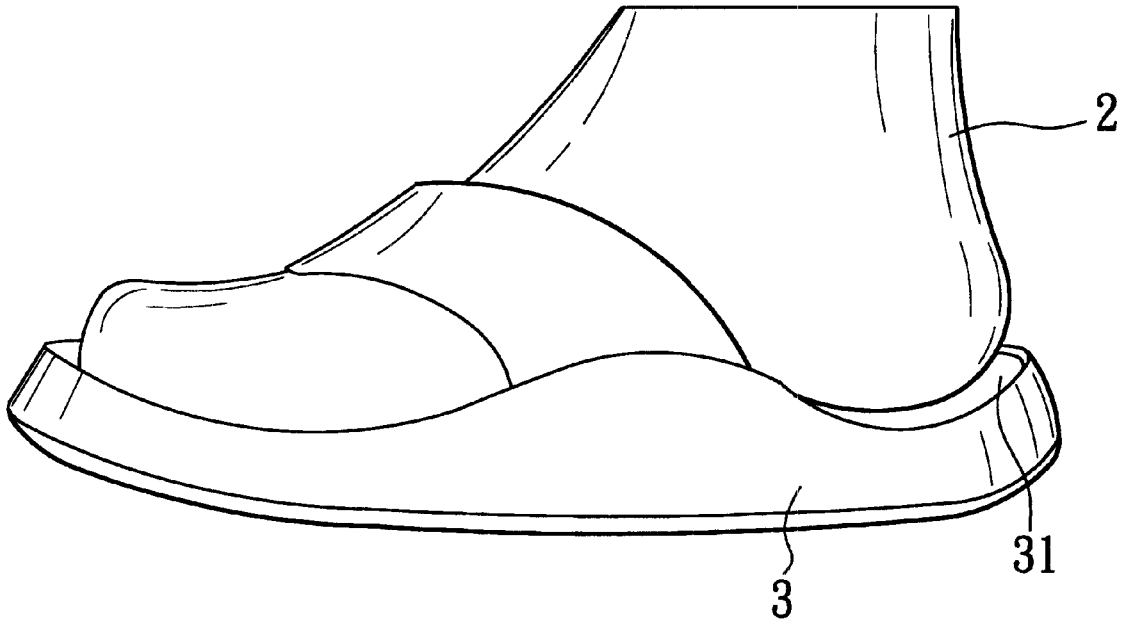
FIG. 3 is a perspective view showing a sandal and the conventional last of FIGS. 2A and 2B.

Although the last 40 has a bottom profile substantially conforming to the bottom face of the wearer's foot like the last 2 shown in FIGS. 2A and 2B, it is feasible to use the last 40 to fabricate the shoe 10 by using a conventional heel lasting machine since the heel part 30 has the planar bottom face 304. The height of the inner surface 307 of the heel part 30 increases gradually from the mid part of the base 301 of the heel part 30 to the top of the upward flange 302, the inner surface 307 of the heel part 30 conforms to the bottom convex surface of the wearer's heel which is the lowest at the mid part of the heel and becomes higher gradually to the lateral side thereof. The insole element 21 follows the contour of the concave inner surface 307 the heel part 30 and contacts and supports almost all area of the wearer's heel. In addition, since the insole unit, comprised of the heel part 30 and the insole element 21, is attached directly to the bottom margin 201 of the upper 20 when it is mounted on the bottom face of the last 40, the thickness of the insole unit or the heel part 30 is not limited by the interior space of the upper 20 into which the last 40 is inserted. The heel part 30 thus has a sufficient thickness to cushion the bottom face of the wearer's heel beneath the calcaneus.

Figure 10:
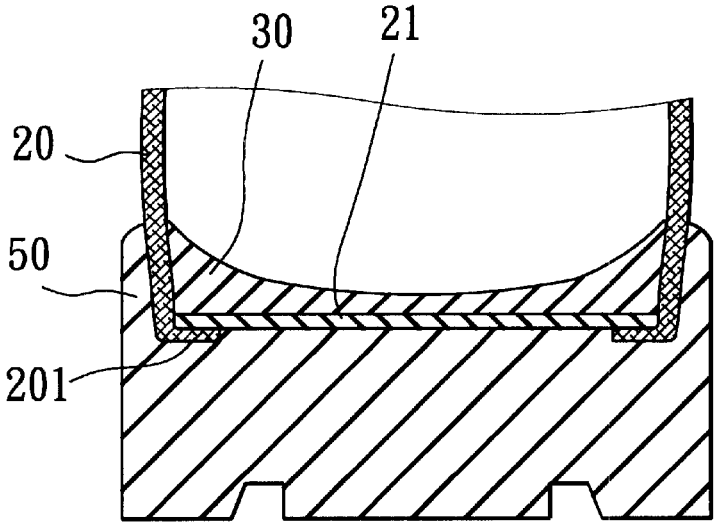
FIG. 10 is the same view as FIG. 5 but with the insole element being placed beneath the heel part.

Referring to FIG. 10, the heel part 30 may be placed above and connected integrally with the insole element 21. In assembly, the heel part 30 together with the insole element 21 is mounted on the last 40 (shown in FIG. 9) to connect with the bottom margin 201 of the upper 20.

Figure 11A:
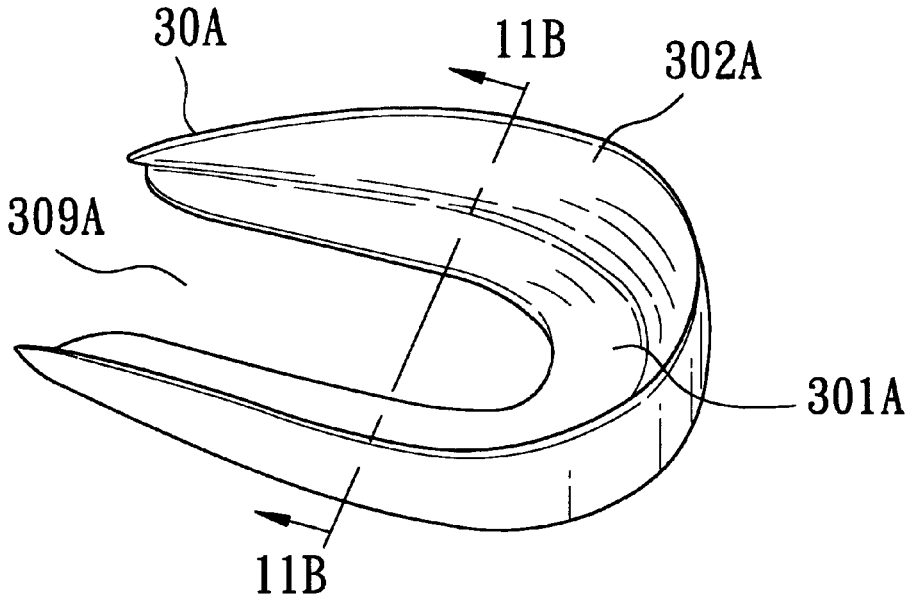
FIG. 11A is a perspective view showing another heel part according to the present invention.
Figure 11B:
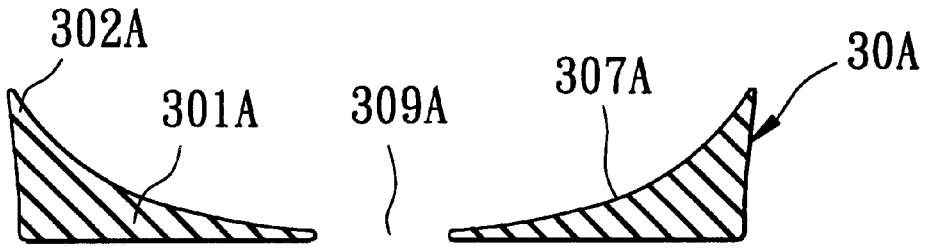
FIG. 11B is a cross-sectional view taken along line 11B—11B of FIG. 11A.

Instead of the heel part 30 described hereinbefore, the ergonomic insole unit according to the present invention may be configured to include a heel part 30A as shown in FIGS. 11A and 11B. The heel part 30A has a base 301A and an upward flange 302A which are substantially the same as the base 301 and the flange 302 of the heel part 30 except that the base 301A is provided with an opening 309A in a mid part thereof. Like the heel part 30, the inner surface 307A of the heel part 30A has a varying height which decreases gradually from the upward flange 302A toward the mid part of the base 301A.

Figure 12:
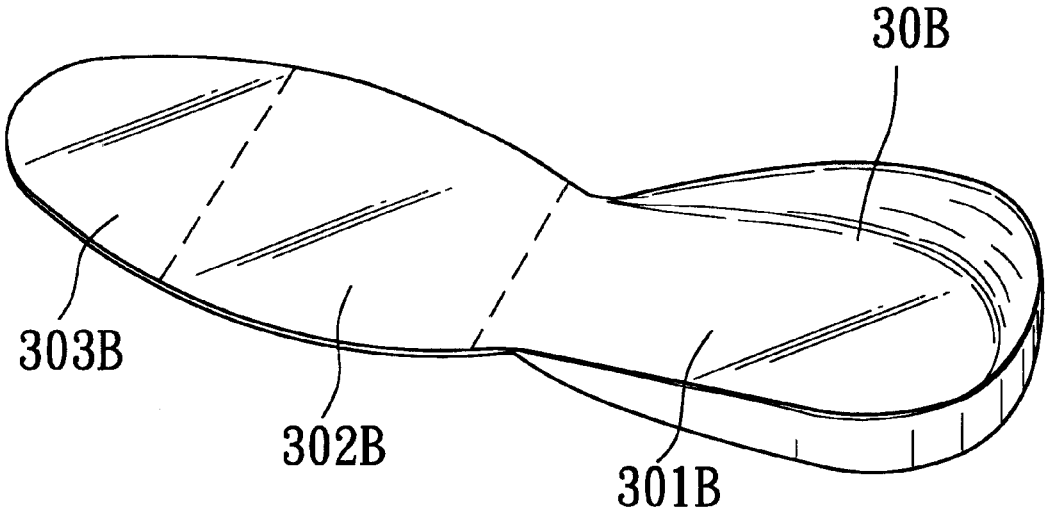
FIG. 12 is a perspective view of another insole unit according to the present invention.

Referring to FIG. 12, the ergonomic insole unit according to the present invention is configured as a single piece member 30B including a heel part 301B, a shank part 302B and a toe part 303B. The heel part 301B has substantially the same configuration as the heel part 30. The shank part 302B and the toe part 303B may be designed such that they are more flexible and have a lower hardness than that of the heel part 301B. The single-piece member 30B may be constructed in such a manner that they have different levels of hardness at the heel, shank and toe parts 301B, 302B and 303B. Furthermore, the hardness of the single piece member 30B may be the same or different at the shank and toe parts 302B and 303B. When the single piece member 30B is used, the upper 20 may be lasted with or without the insole element 21.

Figure 13:
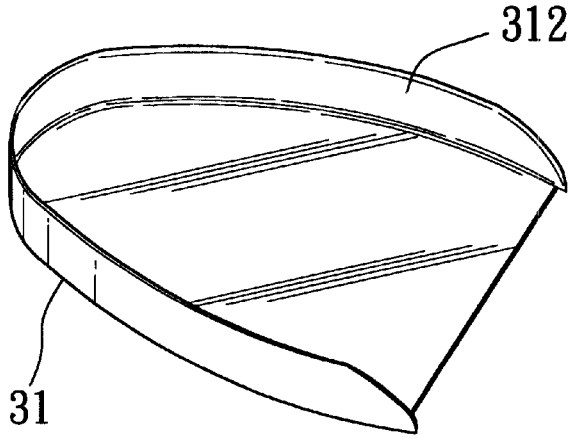
FIG. 13 is a perspective view of a toe part of the insole unit according to the present invention.
Figure 14:
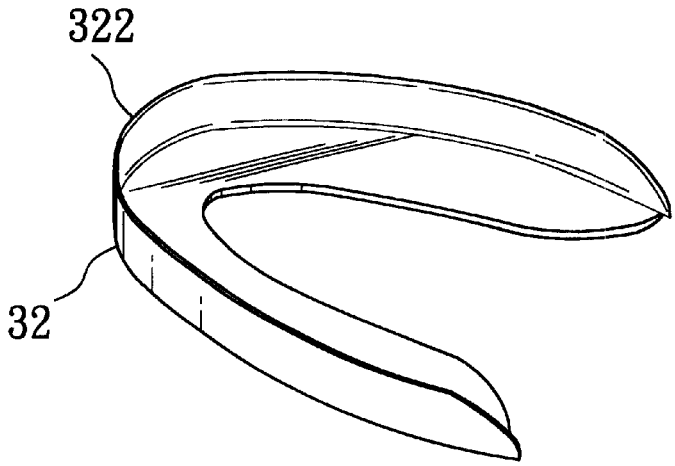
FIG. 14 is a perspective view of another toe part of the insole unit according to the present invention.

Referring to FIGS. 13 and 14, the ergonomic insole unit in the present invention may also include a separate toe part 31, or a separate toe part 32 to be used together with the heel part 30 or 30A. The toe part 31 in FIG. 13 has a front upward flange 312 projecting upward from the periphery of the toe part 31 and having a U-shaped turn along the periphery of the toe part 31. The toe part 32 in FIG. 14 has a front upward flange 322 projecting upward from the periphery of the toe part 32 and having a U-shaped turn along the periphery of the toe part 32. In assembly, the toe part 31 or 32 may be placed above or below the insole element 21, like the heel part 30 or 30A and mounted on the last 40 (shown in FIG. 9) together with the insole element 21.

Figure 15:
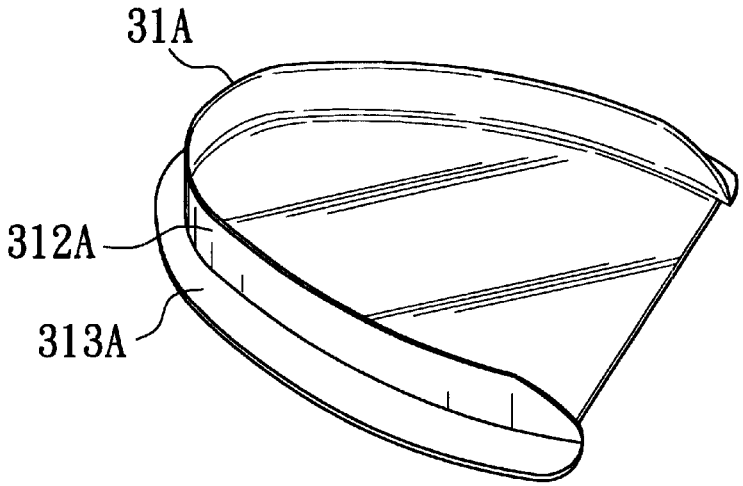
FIG. 15 is a perspective view of a modified form of the toe part of FIG. 13.
Figure 16:
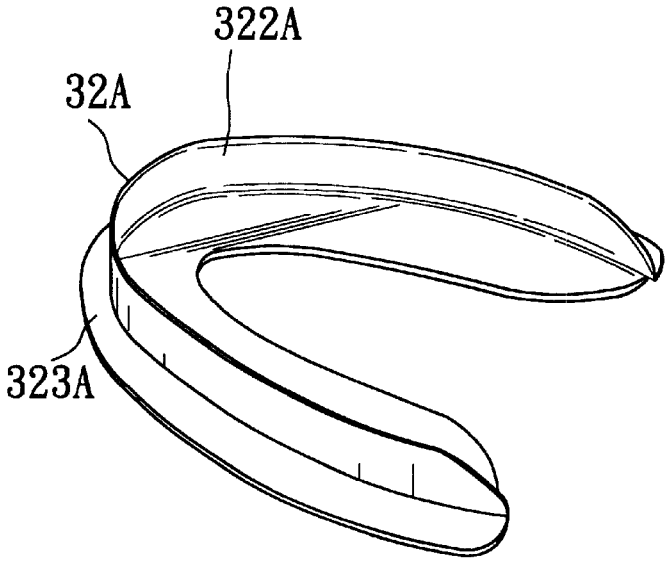
FIG. 16 is a perspective view of a modified form of the toe part of FIG. 14.

Referring to FIGS. 15 and 16, reference numerals 31A and 32A represent respectively another toe parts which are modified forms of the toe parts 31 and 32. The toe part 31A has an additional front outward flange 313A which projects outward from an upward flange 312A along a plane substantially parallel to a planar bottom face (not shown) of the toe part 31A. The toe part 32A has an additional front outward flange 323A which projects outward from an upward flange 322A along a plane substantially parallel to a planar bottom face (not shown) of the toe part 32A.

Figure 17:
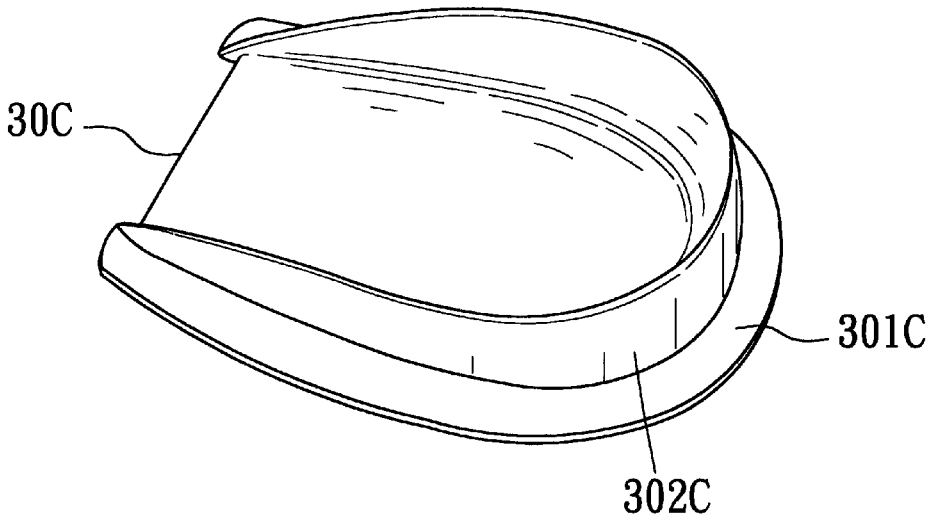
FIG. 17 is a perspective view of a modified form of the heel part of FIG. 6.
Figure 18:
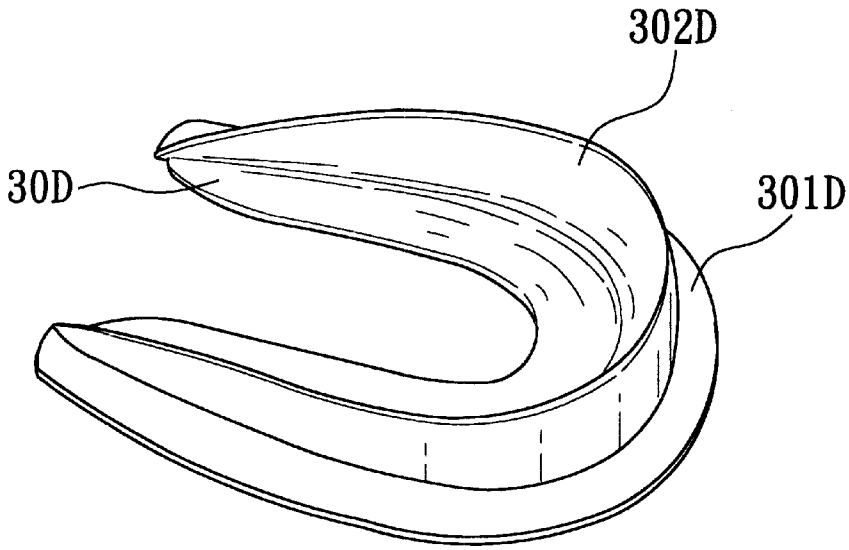
FIG. 18 is a perspective view of a modified form of the heel part of FIG. 11A.

Referring to FIGS. 17 and 18, reference numerals 30C and 30D represent respectively another heel parts which are modified forms of the heel parts 30 and 30A. The heel part 30C has an additional rear outward flange 301C which projects outward from an upward flange 302C along a plane substantially parallel to the planar bottom face (not shown) of the heel part 30C. The heel part 30D has an additional rear outward flange 301D which projects outward from an upward flange 302D along a plane substantially parallel to a planar bottom face (not shown) of the heel part 30D.

Figure 19:
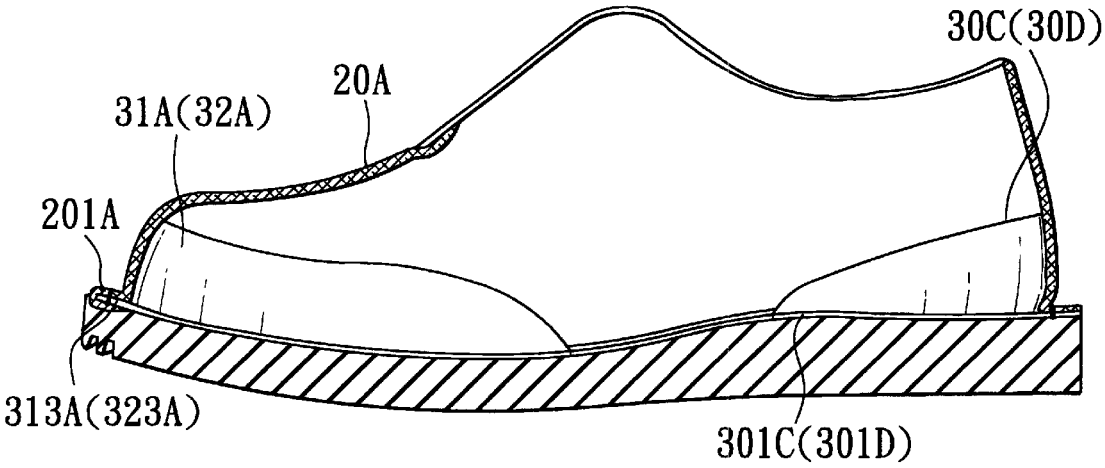
FIG. 19 is an elevation view of another shoe embodying the present invention.

Referring to FIG. 19, the heel part 30C or 30D and the toe part 31A or 32A have the outward flanges 301C or 301D and the outward flanges 313A or 323A thereof connected to an outwardly turned bottom margin 201A of an upper 20A. The heel part 30C or 30D and the toe part 31A or 32A are disposed above the insole element 21 and are interconnected integrally. Assembly of the upper 20A with the insole element 21, the heel part 30C or 30D and the toe part 31A or 32A is accomplished via a conventional stitchdown process using the last 40 which is shown in FIG. 9.

Figure 20:
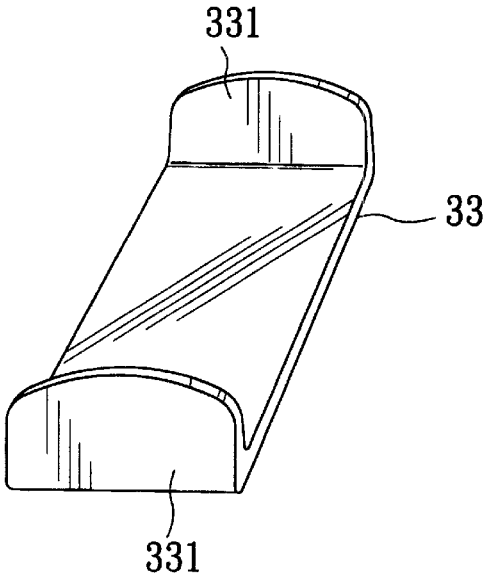
FIG. 20 is a perspective view of a shank part usable in the present invention.

Referring to FIG. 20, the ergonomic insole unit according to the present invention may also include a separate shank part 33 which can be used in combination with the heel part 30 or 30A and the toe part 31 or 32. The shank part 33 has two opposite lateral upward flanges 331 which project upward from two opposite ends of the shank part 33. In assembly, the shank part 33 may be placed above or below the insole element 21 together with the heel part 30 or 30A and/or the toe part 31 or 32 and connected to the bottom margin 201 of the upper 20.

Figure 21:
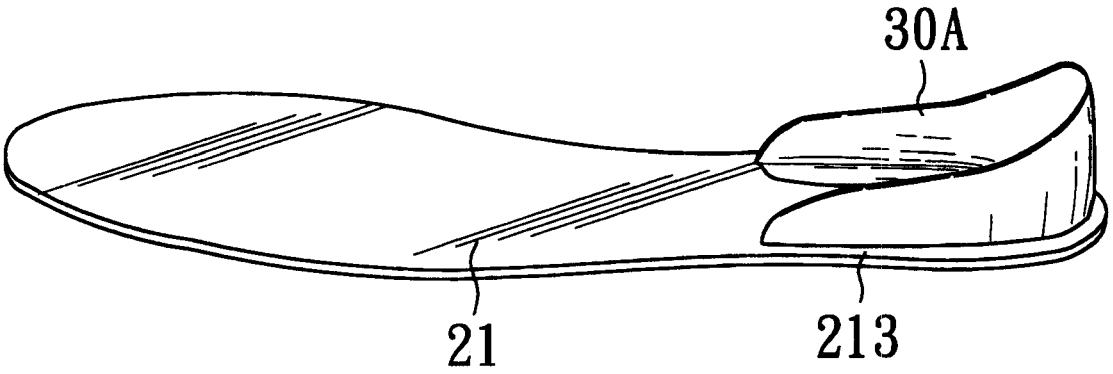
FIG. 21 is a perspective view showing a heel part which is smaller in size than a heel section of an insole element according to the present invention.

Referring to FIG. 21, the heel part 30A maybe configured with a size smaller than the heel section 213 of the insole element 21 so that the periphery of the insole element 21 extends beyond and projects outwardly of the periphery of the heel part 30A when the heel part 30A is disposed above the insole element 21. The outwardly projecting part of the insole element 21 may be connected to the outwardly turned bottom margin 201A of the upper 20A shown in FIG. 19.

As mentioned hereinbefore, due to the use of the ergonomic insole unit according to the present invention, a shoe can be produced via a conventional heel lasting machine while still using a last 2 shown in FIGS. 2A and 2B. In addition, since the insole unit is attached directly to the bottom margin 201 of the upper 20 or the bottom margin 201A of the upper 20A while it is being mounted on the bottom face of the last 40, the insole unit is permitted to have an increased overall thickness with a sufficient thickness at a region corresponding to the wearer's calcaneus. The insole unit can provide support for all areas of the wearer's heel so that the weight of the wearer can be distributed to all areas of the heel and the problem of stress concentration caused to the heel face beneath the calcaneus can be alleviated.

While the present invention has been described in connection with what is considered the most practical and preferred embodiment, it is understood that this invention is not limited to the disclosed embodiments but is intended to cover various arrangements included within the spirit and scope of the broadest interpretation so as to encompass all such modifications and equivalent arrangements.

I claim:

1. A shoe comprising an ergonomic insole unit, and an upper having a bottom margin attached to said insole unit, said insole unit including a heel part which includes a base, a rear upward flange projecting upward from a periphery of said base and making a U-shaped turn around said base, said upward flange extending inwardly of said bottom margin of said upper, said base having a planar bottom face, said rear upward flange having an outer surface extending upward from said planar bottom face and forming a corner with said planar bottom face, said heel part further having a concave inner surface opposite to said outer surface and said planar bottom face, said inner surface extending gradually upward and outward along a direction from a mid part of said base to a top end of said upward flange and having a curved face extending along said corner, said heel part having, between said planar bottom face and said inner surface, a thickness which decreases gradually from said upward flange toward said mid part.

2. The shoe as claimed in claim 1, wherein said insole unit is directly connected to said bottom margin of said upper by inserting a last into said upper and mounting said insole unit directly on a bottom of said last.

3. The shoe as claimed in claim 1, wherein said curved face of said inner surface has a curvature with a diameter greater than 8 mm.

4. The shoe as claimed in claim 1, wherein said insole unit has a bottom side opposite to a top end of said upper, said bottom margin of said upper being folded over and attached to said bottom side of said insole unit.

5. The shoe as claimed in claim 1, wherein said insole unit further includes an insole element which has a toe section, a heel section, and a shank section interconnecting said toe and heel sections, said heel part being formed as a separate piece from said insole element.

6. The shoe as claimed in claim 5, wherein said insole element has a uniform thickness.

7. The shoe as claimed in claim 5, wherein said heel part is disposed beneath said heel section of said insole element and connected integrally to said insole element.

8. The shoe as claimed in claim 5, wherein said heel part is disposed above said heel section of said insole element and connected integrally to said insole element.

9. The shoe as claimed in claim 8, wherein said heel part further includes an opening in said mid part.

10. The shoe as claimed in claim 9, wherein said heel part is smaller than said heel section of said insole element, so that said heel section projects outwardly from the periphery of said heel part, said bottom margin of said upper is turned outward and connected to said insole element.

11. The shoe as claimed in claim 1, wherein said insole unit further includes a toe part, and a shank part connected between said toe part and said heel part, said toe part and said shank part being formed as one piece with said heel part.

12. The shoe as claimed in claim 1, wherein said insole unit further includes a toe part formed as a separate piece from said heel part.

13. The shoe as claimed in claim 12, wherein said toe part includes a front upward flange which projects upward from a periphery of said toe part and which has a substantially U-shaped turn along said periphery of said toe part.

14. The shoe as claimed in claim 13, wherein said toe part further includes a front outward flange which projects outward from said front upward flange along a plane substantially parallel to a bottom face of said toe part.

15. The shoe as claimed in claim 1, wherein said insole unit further includes a shank part formed as a separate piece from said heel part.

16. The shoe as claimed in claim 15, wherein said shank part has two opposite lateral upward flanges which project upward respectively from two opposite ends of said shank part.

17. The shoe as claimed in claim 1, wherein said heel part further has a rear outward flange projecting outward from said upward flange along a plane substantially parallel to said planar bottom face.

18. The shoe as claimed in claim 1, wherein said bottom margin of said upper is turned outward and connected directly to a periphery of said insole unit.

* * * * *